US007021681B2

(12) United States Patent
Hayakawa et al.

(10) Patent No.: US 7,021,681 B2
(45) Date of Patent: Apr. 4, 2006

(54) DOOR LOCK DEVICE

(75) Inventors: Shigeru Hayakawa, Chiryu (JP); Ryujiro Akizuki, Aichi-ken (JP); Norio Konomoto, Nagoya (JP); Katsutoshi Fukunaga, Chiryu (JP); Akira Muramatsu, Chiryu (JP); Makoto Suzumura, Chita (JP); Takeshi Yasuda, Anjo (JP); Kan Ichihara, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/444,972

(22) Filed: May 27, 2003

(65) Prior Publication Data

US 2004/0036298 A1 Feb. 26, 2004

(30) Foreign Application Priority Data

May 24, 2002 (JP) ..... 2002-150976
Aug. 29, 2002 (JP) ..... 2002-250682

(51) Int. Cl.
*E05C 3/16* (2006.01)

(52) U.S. Cl. ..... 292/216; 292/DIG. 23

(58) Field of Classification Search ..... 292/216, 292/201, DIG. 23
See application file for complete search history.

(56) References Cited

U.S. PATENT DOCUMENTS 3,858,919 A * 1/1975 Kleefeld et al. ..... 292/216
5,181,754 A * 1/1993 Shibata ..... 292/216
5,531,488 A * 7/1996 Yoshikuwa et al. ..... 292/216
5,653,484 A 8/1997 Brackmann et al.
5,715,713 A * 2/1998 Aubry et al. ..... 70/277
5,803,515 A * 9/1998 Arabia et al. ..... 292/216
6,079,757 A * 6/2000 Aubry ..... 292/201
6,126,212 A * 10/2000 Fujihara ..... 292/216
6,406,073 B1 6/2002 Watanabe
2001/0030428 A1 10/2001 Kunst et al.
2001/0035653 A1 11/2001 Hayakawa et al.

FOREIGN PATENT DOCUMENTS

DE 38 19 521 A1 12/1988
DE 43 13 248 A1 11/1994
DE 100 46 057 A1 4/2001
DE 100 16 632 A1 10/2001
JP 11-166337 A 6/1999

* cited by examiner

*Primary Examiner*—Gary Estremsky
(74) *Attorney, Agent, or Firm*—Buchanan Ingersoll PC

(57) ABSTRACT

A door lock device includes a latch mechanism, a lift lever, an open lever, a lock lever including a main lever and a sub lever mounted on the main lever so as to relatively rotate thereto, a biasing member disposed between the main lever and the sub lever, and an open member. When the open member is in the unlocked position, the open member engages with the lift lever by an operation of the open lever in one direction thereby allowing the lift lever operable. When the open member is in the locked position, the open member idly engages with the lift lever by the operation of the open lever and then becomes engaged with the lift lever in the other direction thereby prohibiting the lift lever operable when the open member is switched to the unlocked position from the locked position.

15 Claims, 16 Drawing Sheets

DOOR LOCK DEVICE

This application is based on and claims priority under 35 U.S.C. § 119 with respect to Japanese Applications No. 2002-150976 filed on May 24, 2002 and No. 2002-250682 filed on Aug. 29, 2002, the entire content of which is incorporated herein by reference.

FIELD OF THE INVENTION

This invention generally relates to a door lock device.

BACKGROUND OF THE INVENTION

A known door lock device includes a latch mechanism provided at a vehicle door and engageable with or disengageable from a striker provided at a vehicle-body, a lift lever for operating the latch mechanism from an engaged state to a disengaged state by engaging with or disengaging from the striker, an open lever operated by an operation of a door opening member provided at the vehicle door, and a lock lever provided at the vehicle door and movable between an unlocked position and a locked position by an operation of a door locking/unlocking member. The known door lock device further includes an open member operated with the lock lever and movable between the unlocked position and the locked position. When the open member is in the unlocked position, the open member engages with the lift lever by the operation of the open lever in one direction, thereby allowing the lift lever operable. When the open member is in the locked position, the open member idly engages with the lift lever by the operation of the open lever and then becomes engaged with the lift lever in the other direction, thereby prohibiting the lift lever operable when the open member is switched to the unlocked position from the locked position.

According to the known device, an unlocked state is defined when the open member is in the unlocked position while a locked state is defined when the open member is in the locked position. In the unlocked state, the open member is operated with the lift lever by engaging therewith due to the operation of a door handle and the like whereby the latch mechanism disengages from the striker. In the locked state, the open member idly engages with the lift lever and thus the lift lever is not operated even if the door handle is operated. The latch mechanism cannot disengage from the striker accordingly.

When the door handle and the door locking/unlocking member such as a door lock knob are operated at substantially the same time in the locked state, the aforementioned device is known to cause a problem as follows. When the door handle is operated before the operation of the door lock knob, the open member idly engages with the lift lever and then moved to a direction of the unlocked position. In this case, the open member engages with the lift lever in the other direction and thus both the lock lever and the open member cannot be moved to the unlocked position. Thus, when the door handle is returned to a normal position from a pulled position, the door lock knob remains in the locked position even though the door lock knob is once operated to be unlocked (which is called a panic state). It is required to operate the door lock knob again to switch to the unlocked state, which causes the bother of operation. This kind of bother may occur in a door lock system for automatically switching to the unlocked state from the locked state by detecting an approach of the user's hand to the door handle.

The door handle can be operated before the automatic switching to the unlocked state is performed depending on control timing.

A device disclosed in Japanese Patent Laid-Open Publication No. 11-166337 is known to solve the above-mentioned problem. FIG. 17 shows a structure of the disclosed device. The disclosed device includes a lift lever 100 for operating the latch mechanism from the engaged state to the disengaged state by engaging with or disengaging from the striker provided at the vehicle body, an open lever 101 operated by the operation of the door handle provided at the vehicle door, and a lock lever 102 provided at the vehicle door and operated by the operation of the door lock knob and the like. The disclosed device further includes an open link 103 operated with the lock lever 102 and movable between the unlocked position and the locked position. The open link 103 engages with the lift lever 100 in S direction, thereby allowing the lift lever 100 operable when the open link 103 is in the unlocked position. The open link 103 also idly engages with the lift lever 100 in the locked position. The open link 103 includes a main link 103*a* connected to the open lever 101 and the lock lever 102, and a sub link 103*b* mounted on the main link 103*a* via a pin 104 so that the sub link 103*b* relatively rotates to the main link 103*a* and engageable with the lift lever 100. FIG. 17 shows the locked state in which the sub link 103*b* does not engage with the lift lever 100.

The aforementioned disclosed device is operated as follows in the locked state when the door handle and the door lock knob are operated substantially at the same time. The open link 103 is moved in substantially S direction while idly engaging with the lift lever 100 by the operation of the door handle. Then, the open link 103 is moved in T direction, i.e. unlocked position, by the operation of the door lock knob. In this case, the sub link 103*b* engages with the lift lever 100 and relatively rotates to the main link 103*a*. The main link 103*a* of the open link 103 is therefore moved to the unlocked position together with the lock lever 102. When the door handle is returned to the normal position, the sub link 103*b* relatively rotates to the main link 103*a* by a biasing force of a spring 105. Then, the open link 103 as a whole is returned to the unlocked initial position (i.e. recovered from the panic state). It is thus not required to operate the door lock knob again.

The above-mentioned device, however, may have a following problem. The open lever 101 and the main link 103*a* receive torque generated by the operation of the door handle under the door opening operation with the door unlocked. The sub link 103*b* is moved in substantially longitudinal direction thereof (lower-left direction in FIG. 17) by the main link 103*a*. The lift lever 100 is pushed by an edge portion of the sub link 103*b*. The main link 103*a* and the sub link 103*b* are rotatably connected via the pin 104 as mentioned above. Therefore, the sub link 103*b* may not be stably supported relative to the main link 103*a* when the sub link 103*b* pushes the lift lever 100, That is, the sub link 103*b* and the main link 103*a* may relatively rotate to each other and thus the lift lever 100 cannot be accurately pushed. The relative rotation between the sub link 103*b* and the main link 103*a* is restricted by the spring 105. However, if a relative relationship between the biasing force of the spring 105 and torque required for operating the lift lever 100 is changed, the above-mentioned problem may occur and thus operation instability of the door lock device may be caused.

Thus, a need exists for a door lock device which addresses at least the foregoing drawback associated with other known door lock devices.

It would thus be desirable to provide a door lock device which can provide the operation stability and reduce the bother of operation.

SUMMARY OF THE INVENTION

According to an aspect of the present invention, a door lock device includes a latch mechanism provided at a vehicle door and engageable with or disengageable from a striker provided at a vehicle-body, a lift lever for operating the latch mechanism from an engaged state to a disengaged state by engaging with or disengaging from the striker, an open lever operated by an operation of a door opening mechanism provided at the vehicle door, and a lock lever movable between an unlocked position and a locked position by an operation of a door locking/unlocking member provided at the vehicle door and including a main lever connected to the door locking/unlocking member and a sub lever connected to the open member and mounted on the main lever so as to relatively rotate thereto. The lock device also includes a biasing member disposed between the main lever and the sub lever for biasing the sub lever to an initial position before the rotation of the sub lever relative to the main lever starts, and an open member operated with the lock lever and movable between an unlocked position and a locked position. When the open member is in the unlocked position, the open member engages with the lift lever by an operation of the open lever in one direction thereby allowing the lift lever operable. When the open member is in the locked position, the open member idly engages with the lift lever by the operation of the open lever and then becomes engaged with the lift lever in the other direction thereby prohibiting the lift lever operable when the open member is switched to the unlocked position from the locked position.

The door opening mechanism includes an inside handle provided at an inboard side of the vehicle door. When the inside handle is operated under the open member being in the locked position, a cancel lever is operated together with the open lever to shift the open member to the unlocked position. At the same time, a contacting portion formed at the open member for engaging with the lift lever becomes engaged with the lift lever in the one direction.

Further, the door opening mechanism includes an inside handle provided at an inboard side of the vehicle door. When the inside handle is operated under the open member being in the locked position, a cancel lever is operated together with the open lever to shift the open member to the unlocked position. At the same time, a contacting portion formed at the open member for engaging with the lift lever becomes engaged with the lift lever in the other direction.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

A first embodiment of the present invention is explained referring to attached drawings. In each drawing, a vehicle frontward direction, a vehicle rearward direction, a vehicle inboard direction, a vehicle outboard direction, a vehicle upward direction, and a vehicle downward direction are represented by F, R, I, O, U, and D respectively using arrows.

Figure 1:
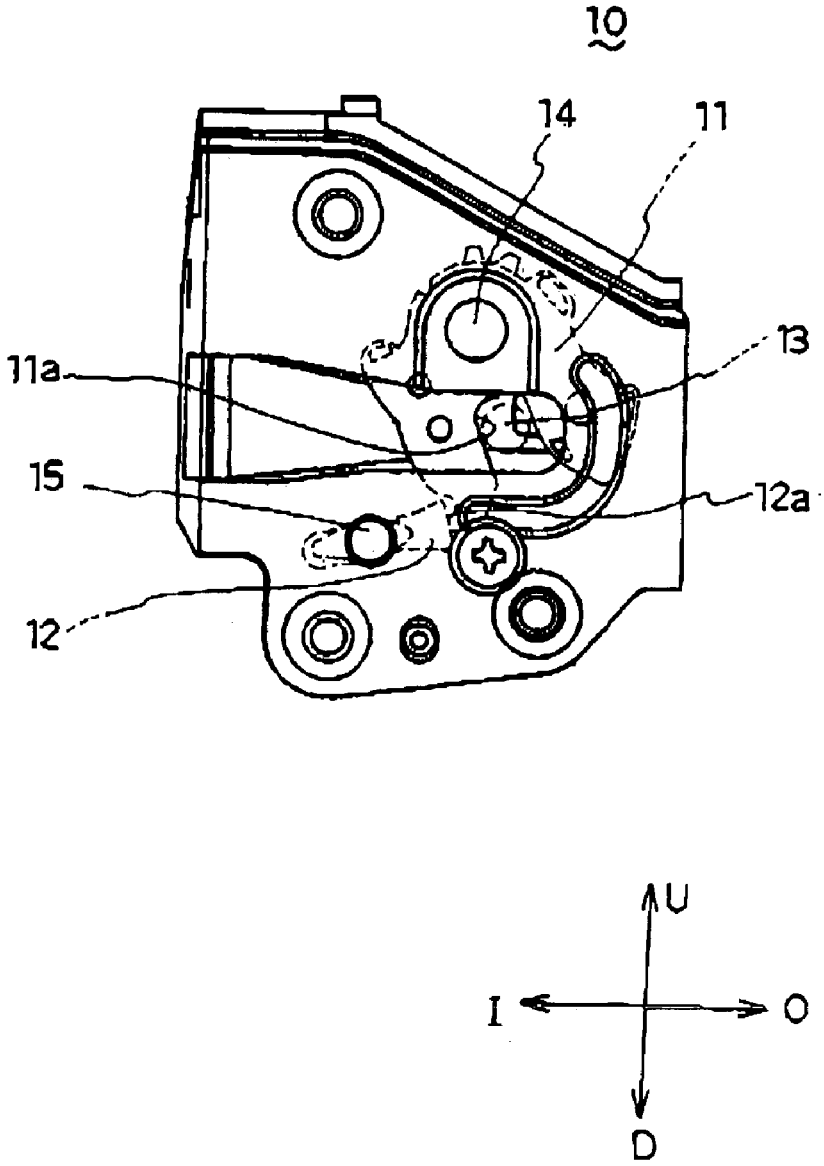
FIG. 1 is a plane view of a latch mechanism of a door lock device according to a first embodiment of the present invention.

A latch mechanism of a door lock device 10 is first explained referring to FIG. 1. The door lock device 10 is provided at a vehicle door (not shown) and including a latch 11 (latch mechanism) and a pawl 12 (latch mechanism). The latch 11 includes a receiving groove 11*a* for receiving and capturing a striker 13 therein provided at a vehicle body (not shown). The pawl 12 includes a contacting portion 12*a* in contact with the latch 11, restricting a rotation of the latch 11. The latch 11 and the pawl 12 are connected to shafts 14 and 15 of the door lock device 10 respectively, being rotatable as a unit with the shafts 14 and 15 respectively.

An operation of the latch mechanism of the door lock device 10 is explained as follows. FIG. 1 shows a latched state in which the latch 11 captures the striker 13. In the latched state, the vehicle door is held at the vehicle body, i.e. door closing held state. When the latch 11 rotates in a clockwise direction in FIG. 1 with a predetermined amount from the latched state, the striker 13 disengages in a leftward direction in FIG. 1, which is an unlatched state. The vehicle door can be thus opened relative to the vehicle body. The latch 11 is biased in the clockwise direction in FIG. 1 by a spring (not shown) arranged around the shaft 14. The latch 11 rotates depending on a biasing force of the spring. The pawl 12 restricts the rotation of the latch 11 via the contacting portion 12*a* in the latched state as mentioned above. When the pawl 12 rotates in the clockwise direction in FIG. 1 with a predetermined amount, the contacting portion 12*a* disengages from the latch 11 whereby the latch 11 rotates to a point where the latch 11 is in the unlatched state. The latch 11 can be operated by the pawl 12 to engage with or disengage from the latch 11. The pawl 12 is also biased in a counterclockwise direction in FIG. 1 by a spring (not shown) arranged around the shaft 15. The latch 11 engages with or disengages from the striker 13 accordingly.

Figure 2:
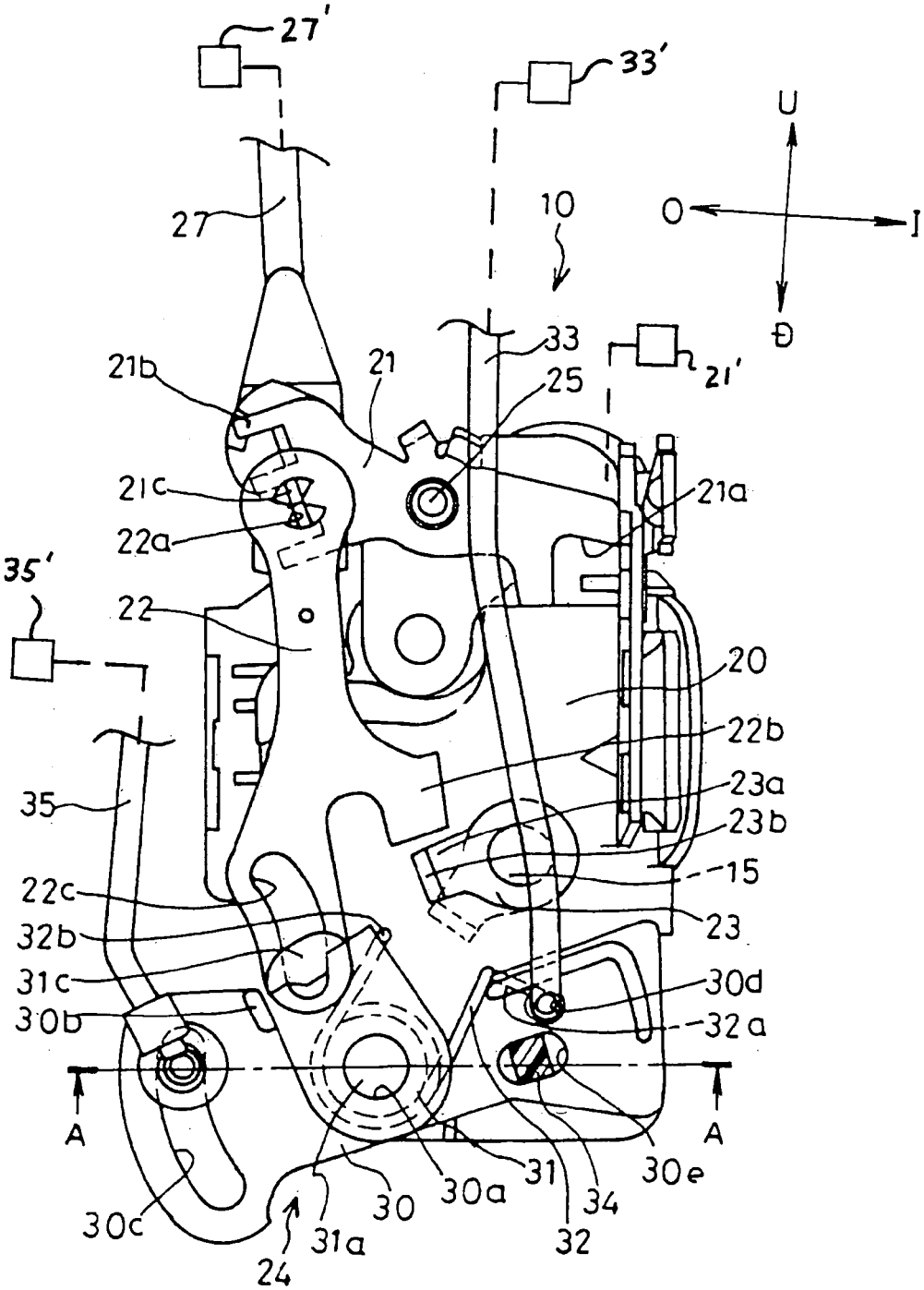
FIG. 2 is a plane view of a lock mechanism of the door lock device according to the first embodiment of the present invention.
Figure 3:
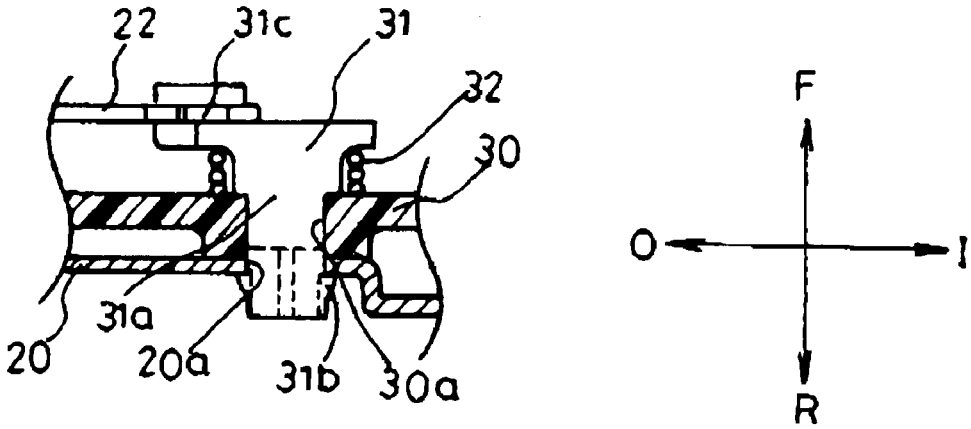
FIG. 3 is a cross-sectional view taken along the line A—A of FIG. 2.
Figure 4:
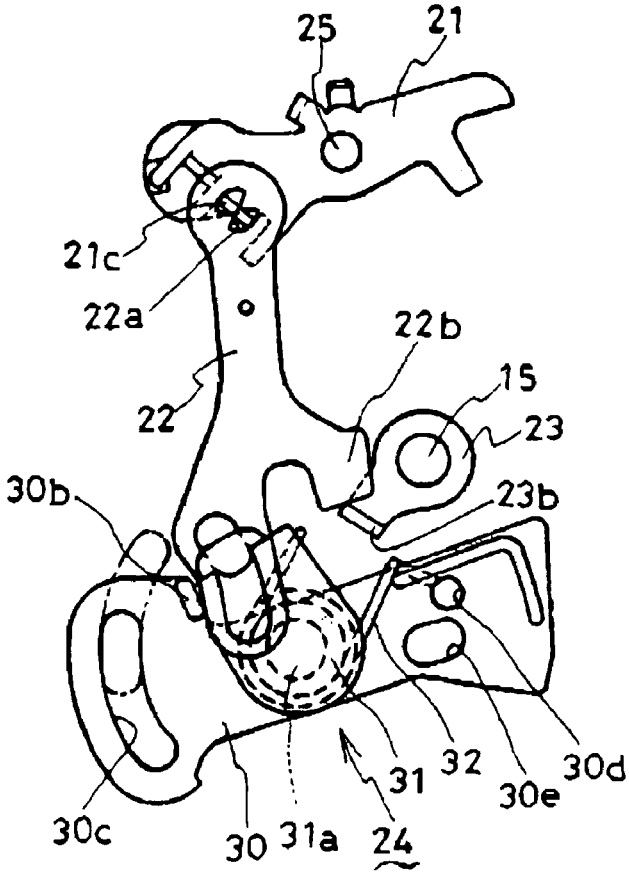
FIG. 4 is a plane view showing a state in which a door handle is operated in an unlocked state of the lock mechanism of the door lock device according to the first embodiment of the present invention.

A lock mechanism of the door lock device 10 is explained referring to FIGS. 2 and 3. The lock mechanism of the door lock device 10 substantially includes an opening operation member and a locking operation member. The opening operation member actuates the latch 11 to open the door relative to the vehicle body in response to an operation of an outside handle (door opening member) (not shown) provided at the outboard side of the vehicle door or an inside handle (door opening member) (not shown) provided at the inboard side of the vehicle door. The locking operation member switches an unlocked state in which the latch 11 can be operated and a locked state in which the latch 11 cannot be operated therebetween by the operation of the outside handle and the like in response to an operation of a key cylinder (door locking/unlocking member) 35' (schematically shown in FIG. 2) or a door lock knob (door locking/unlocking member) 33' (schematically shown in FIG. 2).

The opening operation member includes an open lever 21, an open link 22 (open member), and a lift lever 23 provided on a base 20 as shown in FIG. 2.

The open lever 21 is rotatably connected to the base 20 via a pin 25 provided at a substantially center portion of the open lever 21 in a longitudinal direction thereof. The open lever 21 is biased in the clockwise direction in FIG. 2 by a spring (not shown). The open lever 21 includes an engaging tip portion 21*a* at a right end in FIG. 2. The engaging tip portion 21*a* is operated by the operation of the inside handle 21' (schematically shown in FIG. 2) provided at the vehicle-inboard side via another lever (not shown) and the like. The open lever 21 rotates in the counterclockwise direction in FIG. 2 with a predetermined amount with respect to the pin 25 by the operation of the inside handle.

The open lever 21 also includes a connecting tip portion 21*b* and an engaging detent portion 21*c* on an opposite side to the engaging tip portion 21*a* with respect to the pin 25. The connecting tip portion 21*b* is connected to a rod 27 connected to the outside handle 27' (schematically shown in FIG. 2) provided at the outboard side of the vehicle door. The open lever 21 also rotates in the counterclockwise direction in FIG. 2 with a predetermined amount with respect to the pin 25 by the operation of the outside handle. The engaging detent portion 21*c* is bent and extending from the open lever 21 in the vehicle frontward direction. The engaging detent portion 21*c* engages with the open link 22 and thus the open link 22 and the open lever 21 are connected to each other.

The open link 22 includes a connecting hole 22*a*, an engaging portion 22*b* and an elongated hole 22*c*. The connecting hole 22*a* is of a figure-eight shape formed at one end (upper end in FIG. 2) of the open link 22 and engages with the engaging detent portion 21*c* of the open lever 21. The other end (lower end in FIG. 2) of the open link 22 is formed with the elongated hole 22*c* extending in a longitudinal direction of the open link 22. The engaging portion 22*b* extends from a substantially center portion of the open link 22 toward a lower right direction in FIG. 2. The engaging portion 22*b* is provided adjacent to the lift lever 23.

The lift lever 23 is rotatably connected to the shaft 15 to which the pawl 12 is rotatably connected. The lift lever 23 is formed with a flange 23*b* at an edge portion of an arm portion 23*a* extending in the vehicle frontward direction. The lift lever 23 integrally rotates with the pawl 12 with respect to the shaft 15. That is, the pawl 12 rotates in the clockwise direction in FIG. 1 when the lift lever 23 rotates in the counterclockwise direction in FIG. 2 so that the latch 11 is switched from the latched state to the unlatched state.

The locking operation member includes a locking lever 24 (lock lever) and the like. The locking lever 24 includes a main lever 30 and a sub lever 31 as shown in FIG. 2.

The main lever 30 is formed with a hole portion 30*a* at a substantially center portion in a longitudinal direction, which substantially extends from right to left in FIG. 2, of the main lever 30. The sub lever 31 is provided upon the main lever 30. As shown in FIGS. 2 and 3, the sub lever 31 includes a connecting shaft 31*a* integrally extending through the hole portion 30*a* formed at the main lever 30 and a hole portion 20*a* formed at the base 20. An engaging portion 31*b* is formed at a tip portion of the connecting shaft 31*a*. According to the above-mentioned structure, the main lever 30 and the sub lever 31 are each rotatably connected to the base 20 via the connecting shaft 31*a*. The main lever 30 and the sub lever 31 also relatively rotate to each other via the connecting shaft 31*a*.

A spring 32 (biasing member) is disposed between the main lever 30 and the sub lever 31. One end 32*a* of the spring 32 engages with the main lever 30 while the other end 32*b* of the spring 32 engages with the sub lever 31. Further, the main lever 30 is formed with a stopper 30*b* extending in the vehicle frontward direction. According to the above-mentioned structure, the sub lever 31 is biased in a direction in which the sub lever 31 is in contact with the stopper 30*b* by a biasing force of the spring 32. As shown in FIGS. 2 and 3, a connecting pin 31*c* is formed at an upper tip portion of the sub lever 31 extending in the vehicle frontward direction (upper direction in FIG. 3). The connecting pin 31*c* is inserted into the elongated hole 22*c* of the open link 22 so that the sub lever 31 is connected to the open link 22.

The main lever 30 includes a connecting elongated hole 30*c* at a left end portion in FIG. 2, and connecting holes 30*d* and 30*e* at a right end portion in FIG. 2. The connecting elongated hole 30c is connected to the key cylinder (door locking/unlocking member) 35' (schematically shown in FIG. 2) provided at the outboard side of the vehicle door via a rod 35 and the like. The connecting hole 30*d* is connected to the door lock knob 33' (schematically shown in FIG. 2) provided at the inboard side of the vehicle door via a rod 33 and the like. An output arm 34 of a locking actuator (not shown) is inserted into the connecting hole 30*e*. The locking actuator is operated by ECU (not shown) provided inside of the vehicle body. The ECU sends an operation signal to the locking actuator in response to a signal from a door lock/unlock switch (door locking/unlocking member) (not shown) provided in the vehicle, a keyless entry switch (door locking/unlocking member) (not shown) provided in the key, a human body detecting system (referred to as a smart key entry system) composed of an electrostatic capacity sensor (not shown) provided near the outside handle, or a pressing type switch (door locking/unlocking member), if provided, at the outside handle. According to the above-mentioned structure, the main lever 30 is rotatable relative to the base 20 with respect to the connecting shaft 31*a* by the operation of the locking actuator.

An operation of the door lock device 10 is explained referring to FIGS. 2, 4–8. In FIGS. 4–8, operations of the open lever 21, the open link 22, the lift lever 23, and the locking lever 24 are only shown.

An operation for opening the vehicle door by the outside handle and the like is explained as follows. FIG. 2 shows the unlocked state of the door lock device 10. In the unlocked state, the engaging portion 22*b* of the open link 22 is arranged at an upper side of the lift lever 23, i.e. the open link 22 is in an unlocked position. At this time, the locking lever 24 as a whole is in the unlocked position. When the door is operated to open via the outside handle in this state, the open link 22 is moved downward via the open lever 21 and the like. The engaging portion 22*b* of the open link 22 becomes engaged with the flange 23*b* of the lift lever 23 in the vehicle downward direction (one direction) and pushes the flange 23*b*. The lift lever 23 then rotates in the counterclockwise direction in FIG. 4 with respect to the shaft 15. The door lock device 10 is switched to the unlatched state accordingly.

An operation for switching the unlocked state and the locked state therebetween of the door lock device 10 by the locking actuator and the like is explained as follows. The locked state means a state in which the door cannot be opened by the operation of the outside handle and the like (i.e. the latch 11 cannot be switched from the latched state to the unlatched state).

Figure 5:
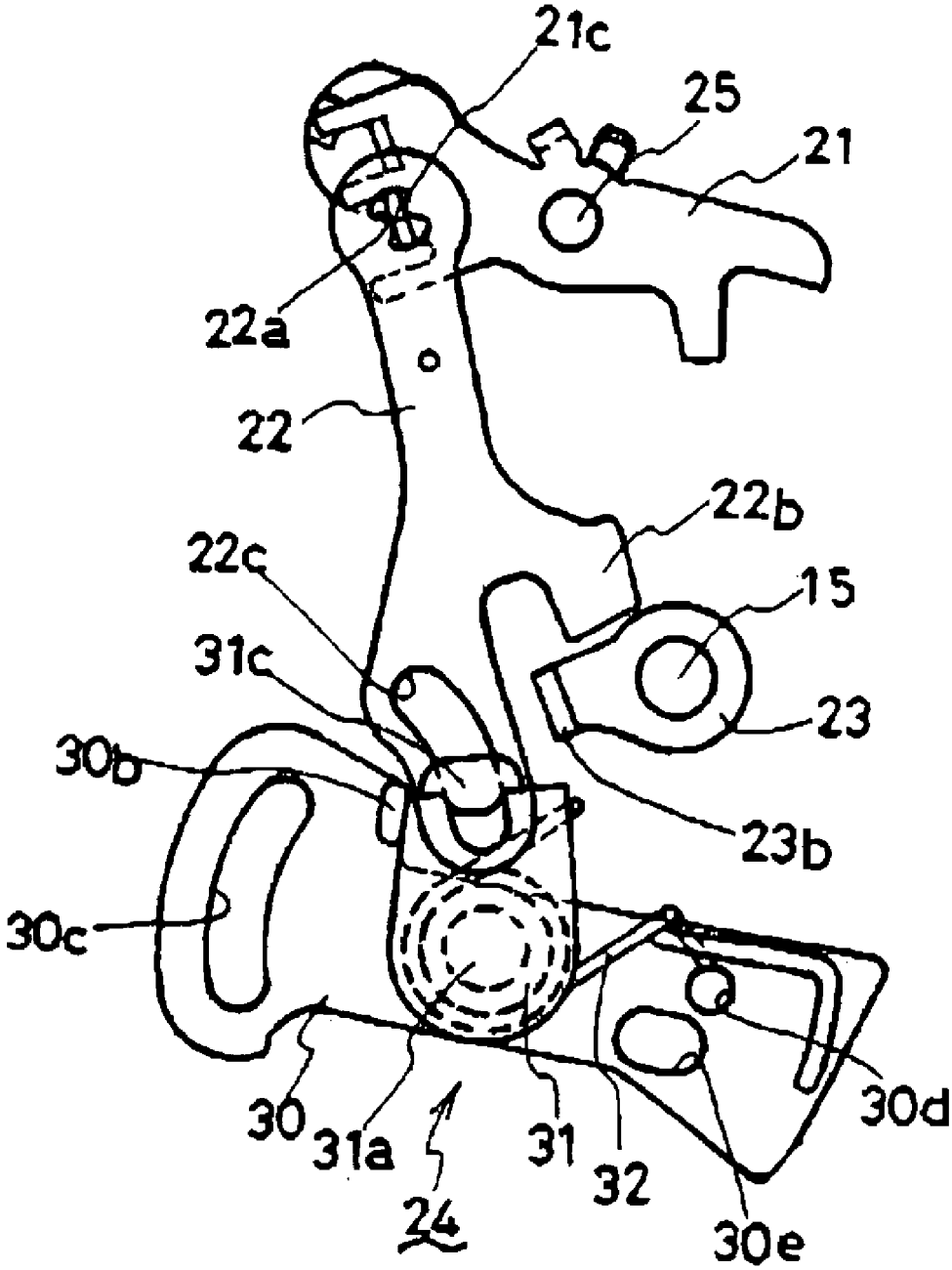
FIG. 5 is a plane view showing a locked state of the lock mechanism of the door lock device according to the first embodiment of the present invention.

When the lock operation (i.e. switching to the locked state) is performed in the unlocked state in FIG. 2 by an actuation of the locking actuator for example, the main lever 30 rotates in the clockwise direction in FIG. 2 with a predetermined amount with respect to the connecting shaft 31*a*. At this time, the stopper 30*b* pushes the sub lever 31 whereby the sub lever 31 integrally rotates with the main lever 30. The open link 22 is then operated with the sub lever 31 via the connecting pin 31*c* and the elongated hole 22*c*. The open link 22 rotates in the counterclockwise direction in FIG. 2 with a predetermined amount with respect to the connecting hole 22*a* as shown in FIG. 5. In FIG. 5, the locking lever 24 as a whole and the open like 22 are in the locked state as in the locked position, When the main lever 30 rotates in the counterclockwise direction from the locked state shown in FIG. 5 by the operation of the locking actuator and the like, the sub lever 31 is also pushed in the same direction as the main lever 30 by the biasing force of the spring 32. The sub lever 31 thus integrally rotates with the main lever 30. The open link 22 is then moved to the unlocked position and placed in the unlocked state shown in FIG. 2. The biasing force of the spring 32 is set larger than the torque required for the open link 22 to move from the locked position to the unlocked position. Thus, under the above-mentioned operation, the sub lever 31 does not relatively rotate to the main lever 30.

Figure 6:
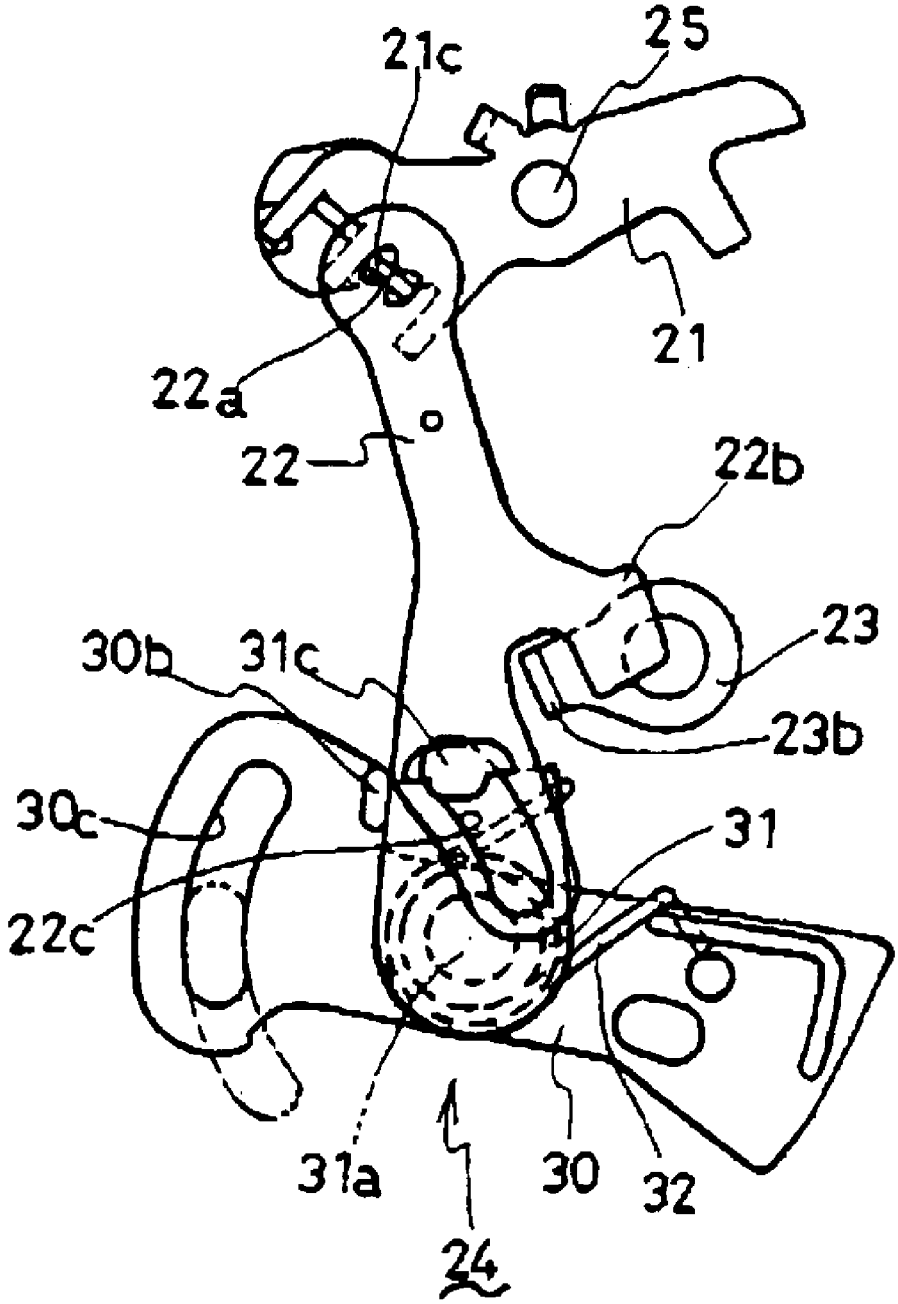
FIG. 6 is a plane view showing a state in which the door handle is operated in the locked state of the lock mechanism of the door lock device according to the first embodiment of the present invention.

When the outside handle is operated (i.e. vehicle door is operated to open) in the locked state, the open link 22 is moved in substantially downward direction as shown in FIG. 6. At this time, the engaging portion 22*b* idly engages with the flange 23*b*, which results in a disengagement between the open link 22 and the lift lever 23. Thus, when the vehicle door is operated to open in the locked state, the vehicle door is not in the unlatched state as the lift lever 23 is not operated.

Figure 7:
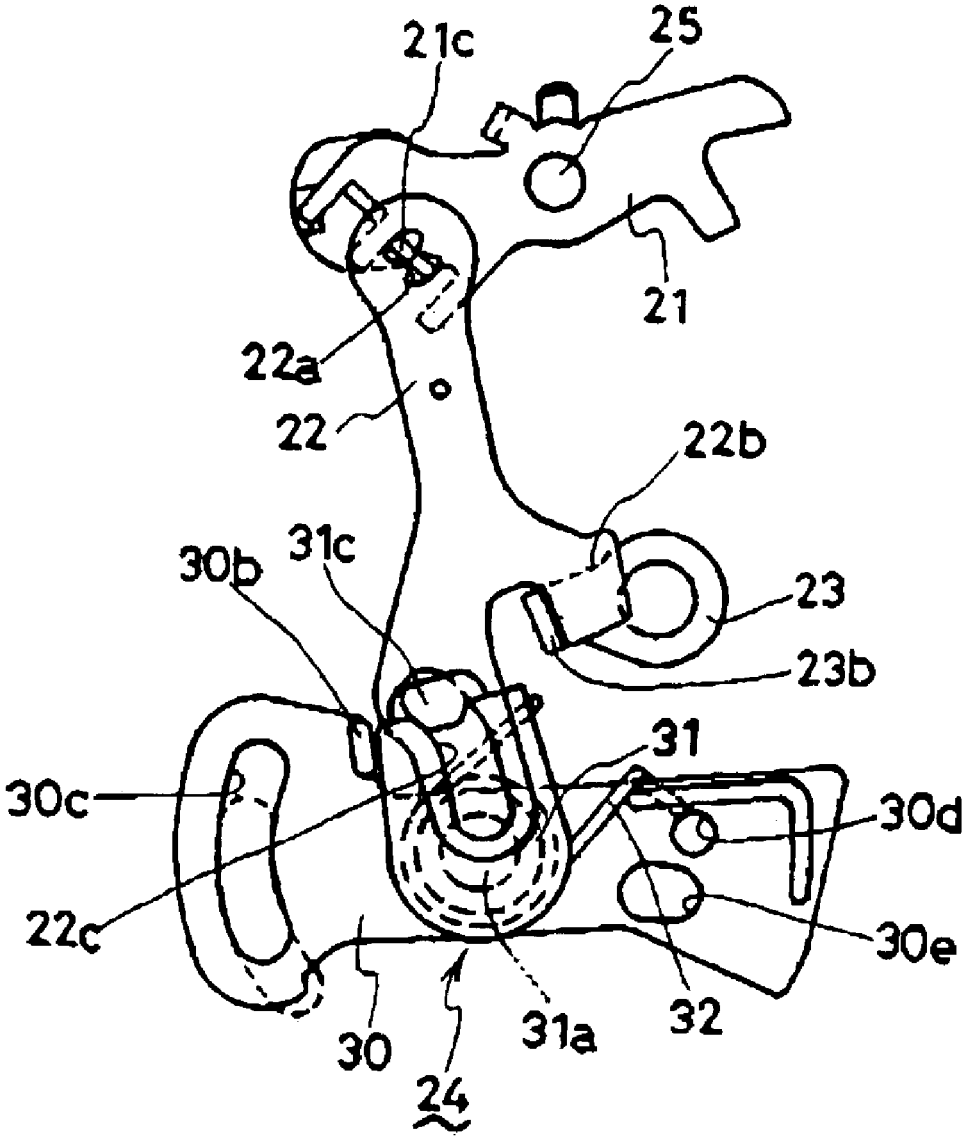
FIG. 7 is a plane view showing a state in which an unlock operation is performed from the state of FIG. 6.
Figure 8:
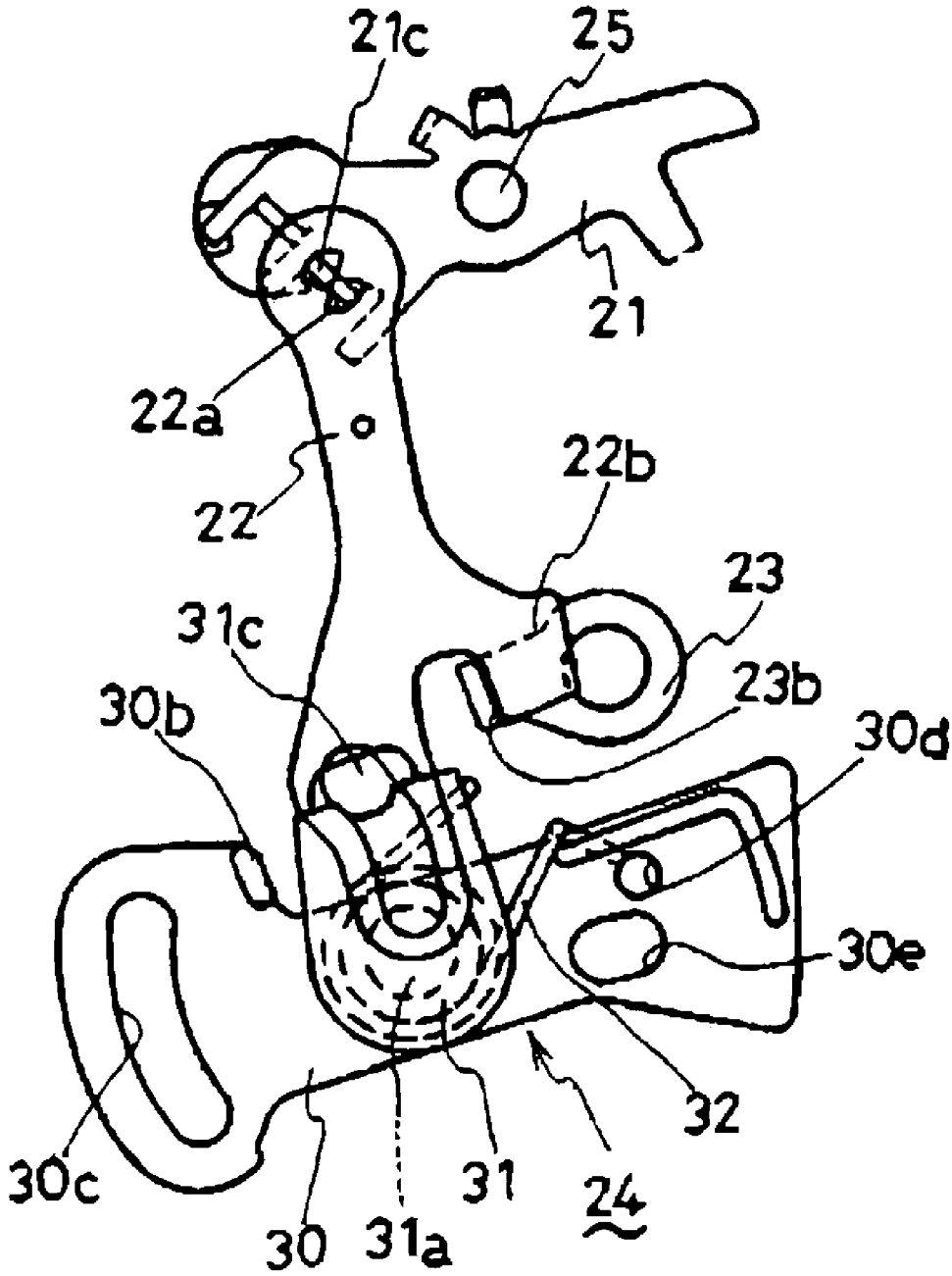
FIG. 8 is a plane view showing a state in which the unlock operation is further performed from the state of FIG. 7.

When the unlocked operation (i.e. switching to the unlocked state) is performed in the state shown in FIG. 6 by the operation of the locking actuator for example, the main lever 30 rotates in the counterclockwise direction in FIG. 6 with respect to the connecting shaft 31*a*. At this time, the open link 22 is moved to the unlocked position via the sub lever 31. The engaging portion 22*b* then engages with the flange 23*b* in the vehicle outboard direction (other direction) as shown in FIG. 7. The sub lever 31 relatively rotates to the main lever 30 against the biasing force of the spring 32 due to the further operation of the locking actuator and the like as shown in FIG. 8. In FIG. 8, when the outside handle is returned to a normal position, the open link 22 is moved upward, thereby releasing the engagement between the engaging portion 22*b* and the flange 23*b*. The sub lever 31 rotates to an initial position (counterclockwise direction in FIG. 8) where the sub lever 31 has been positioned before integrally rotating to the main lever 30 with a predetermined amount with respect to the connecting shaft 31*a* by the biasing force of the spring 32. At the same time, the open link 22 rotates in the clockwise direction in FIG. 8 with a predetermined amount with respect to the connecting hole 22*a*. According to the above-mentioned structure, the door lock device 10 is placed in the unlocked state shown in FIG. 2.

As mentioned above, even if the outside handle and the locking actuator are operated substantially at the same time in the locked state of the vehicle door, the vehicle door is switched to the unlocked state when the outside handle is returned to the normal position. The vehicle door does not require to be switched to the unlocked state again and thus the bother of operation can be reduced.

According to the aforementioned embodiment, the open link 22 is not divided into plural portions to achieve reduction of the bother of operation. Thus, it is stable when the open link 22 engages with the lift lever 23 and operated therewith under the normal door opening operation. In addition, the locking lever 24 includes the main lever 30 and the sub lever 31 which relatively rotate to each other. The main lever 30 and the sub lever 31 are each rotatably connected to the base 20 via the connecting shaft 31*a*. The rotations of the main lever 30 and the sub lever 31 are therefore stable and also a structure how the main lever 30 and the sub lever 31 are rotatably connected to the base 20 is simplified.

A second embodiment of the present invention is explained referring to FIGS. 9–15 The latch mechanism of a door lock device 50 according to the second embodiment is same as that of the first embodiment. An explanation of the latch mechanism of the second embodiment is thus omitted.

Figure 9:
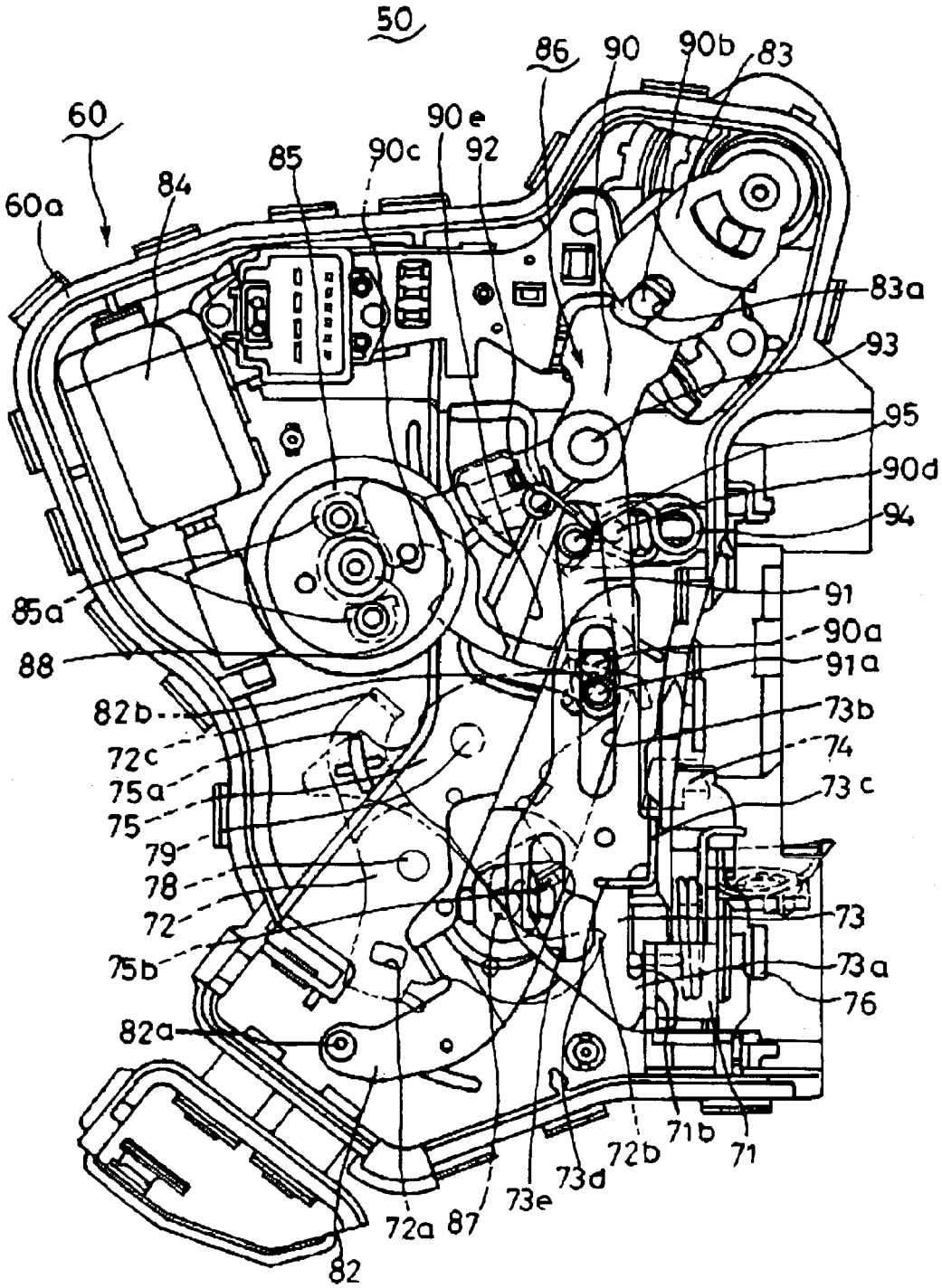
FIG. 9 is a plane view showing the lock mechanism of the door lock device according to a second embodiment of the present invention.

The lock mechanism of the door lock device 50 is explained with reference to FIG. 9. The door lock device 50 includes a housing 60 where each member is accommodated. The housing 60 includes a case portion 60*a* and a cover (not shown). FIG. 9 is a plane view showing a state in which main members are accommodated in the case portion 60*a*.

The door lock device 50 also includes the opening operation member and the locking operation member in the same way as the first embodiment.

The opening operation member includes an outside open lever 71 (open lever), an inside open lever 72 (open lever) (shown by chain double-dashed line in FIG. 9), an open link 73 (open member), a lift lever 74 (shown by chain double-dashed line in FIG. 9), and a cancel lever 75 (shown by chain double-dashed line in FIG. 9).

The outside open lever 71 is rotatably connected to a shaft 76 extending in the longitudinal direction of the vehicle. One end of the outside open lever 71 is formed with a connecting hole 71*a* (shown in FIG. 10) to which the outside handle is connected via a rod and the like (not shown). The other end of the outside open lever 71 is formed with a connecting hole 71*b* having a substantially figure-eight shape. The outside open lever 71 rotates with respect to the shaft 76 when the outside handle is operated.

The inside open lever 72 is rotatably secured to the other case portion of the housing 60 via a pin 78. The inside open lever 72 includes a connecting hole 72*a*. The connecting hole 72*a* receives an operation force from the inside handle via another open lever (not shown) provided outside of the housing 60, a rod (not shown) and the like. The inside open lever 72 rotates by the operation force from the inside handle. The inside open lever 72 also includes a projecting portion 72*b* and a flange 72*c*.

The open link 73 is a rigid metallic sheet which includes a connecting portion 73*a* formed at an lower end portion (in the vehicle downward direction) of the open link 73, an elongated hole 73*b* formed at an upper end portion (in the vehicle upward direction) of the open link 73, a flange 73*c* (engaging portion) formed at a substantially center portion in the longitudinal direction (up and down direction of the vehicle) of the open link 73, a flange 73*d* substantially perpendicular to the flange 73*c* being bent therefrom, and a hole 73*e*.

The connecting portion 73*a* is connected inside of the connecting hole 71*b* of the outside open lever 71. The torque is transmitted to the open link 73 from the outside open lever 71 via this portion where the connecting portion 73*a* and the connecting hole 71*b* are connected to each other. That is, when the outside open lever 71 rotates with respect to the shaft 76, the open link 73 is operated at the same time to be moved upward and downward.

The flange 73*c* is arranged adjacent to the lift lever 74 as shown in FIG. 9. The lift lever 74 is connected to the shaft 15, to which the pawl 12 is connected, so as to be rotatable as a unit. When the lift lever 74 is moved upward in FIG. 9, the pawl 12 rotates in the clockwise direction in FIG. 1.

When the inside open lever 72 rotates in the counterclockwise direction in FIG. 9, the projecting portion 72*b* becomes engaged with the flange 73*d*. That is, the torque is input to the flange 73*d* from the inside open lever 72 due to the engagement between the projecting portion 72*b* and the flange 73*d* when the inside open lever 72 rotates. The open link 73 is then moved upward in FIG. 9. Details of the elongated hole 73*b* and the hole 73*e* of the open link 73 is described later.

The cancel lever 75 is rotatably secured to the case portion 60*a* via a pin 79. The cancel lever 75 includes a projecting portion 75*a* and a boss 75*b*. When the inside open lever 72 rotates in the counterclockwise direction in FIG. 9, the flange 72*c* becomes engaged with the projecting portion 75*a*. The inside open lever 72 and the cancel lever 75 are therefore operated together after the flange 72*c* and the projecting portion 75*a* engage with each other. The boss 75*b* is connected inside of the hole 73*e* of the open link 73.

The locking operation member of the door lock device 50 includes an inside locking lever 82, a key lever 83, a motor 84, a wheel gear 85, an active lever 86 (lock lever) and the like. The inside locking lever 82 is rotatably secured to the case portion 60*a* via a pin 87. A connecting hole 82*a* formed at one end of the inside locking lever 82 is connected to the door lock knob provided at the vehicle-inboard side of the door via a cable (not shown) and the like. The inside locking lever 82 rotates with respect to the pin 87 by the operation of the door lock knob. A connecting elongated hole 82*b* is formed at the other end of the inside locking lever 82.

The key lever 83 is connected do the key cylinder provided at the vehicle-outboard side of the door via a rod (not shown) and the like. The key lever 83 rotates when the key cylinder is operated by a key. The key lever 83 includes a connecting notch 83*a*.

The motor 84 is actuated by ECU (not shown) provided in the vehicle door or the vehicle body in the same manner as the locking actuator according to the first embodiment. The wheel gear 85 is rotatably provided at the case portion 60*a* via a shaft 88 and rotates in response to the driving of the motor 84. The wheel gear 85 includes a pair of connecting pins 85*a*.

The active lever 86 having a substantially fan shape includes a main lever 90, a sub lever 91 and a spring 92 (biasing member). The main lever 90 is rotatably provided at the case portion 60*a* via a shaft 93. The main lever 90 is integrally formed with a connecting pin 90*a* and a control pin 90*d* extending from the main lever 90 towards the case portion 60*a*, a connecting pin 90*b* extending from the main lever 90 toward the opposite side to the case portion 60*a*, and a connecting concave portion 90*c*.

The connecting pin 90*a* is connected to the connecting elongated hole 82*b* of the inside locking lever 82. The connecting pin 90*b* is connected to the connecting notch 83*a* of the key lever 83. The pair of connecting pins 85*a* are engageable with or disengageable from the connecting concave portion 90*c* depending on the rotation of the wheel gear 85. The main lever 90 is connected to the inside locking lever 82, the key lever 83, the wheel gear 85, and also the motor 84 to which the operation force is input from the door locking/unlocking member. The main lever 90 rotates with respect to the shaft 93 due to the operation of the inside locking lever 82, the key lever 83 and the motor 84. When the main lever 90 rotates, the control pin 90*d* is moved within a space defined by a control spring 94 secured to the case portion 60*a*. According to a shape of the control spring 94 for holding the control pin 90*d* and a structure of the control pin 90*d*, a moderate rotational behavior can be obtained.

The sub lever 91 is mounted on the main lever 90 via a shaft 95 so as to relatively rotate thereto. The main lever 90 includes a concave portion 90*e* having a substantially fan shape which base portion is provided with the shaft 95 dented toward the case portion 60*a*. The sub lever 91 is moved within the concave portion 90*e*. At this time, the movement of the sub lever 91 is restricted by right side and left side walls of the concave portion 90*e* as shown in FIG. 9. One end of the spring 92 engages with the main lever 90 while the other end of the spring 92 engages with an end portion of the sub lever 91 above the shaft 95. The spring 92 biases the sub lever 91 in a direction where the sub lever 91 is in contact with the right side wall of the concave portion 90*e* of the sub lever 91 (initial position) as shown in FIG. 9.

A connecting pin 91*a* formed at an end portion below the shaft 95 of the sub lever 91 extends in the opposite direction to the case portion 60*a*. The connecting pin 91*a* is connected to the elongated hole 73*b* of the open link 73. That is, the sub lever 91 is connected to the open link 73. When the sub lever 91 or the active lever 86 as a whole rotates, the open link 73 is also operated (rotates relative to the outside open lever 71 with respect to the connecting portion 73*a*) at the same time.

Figure 10:
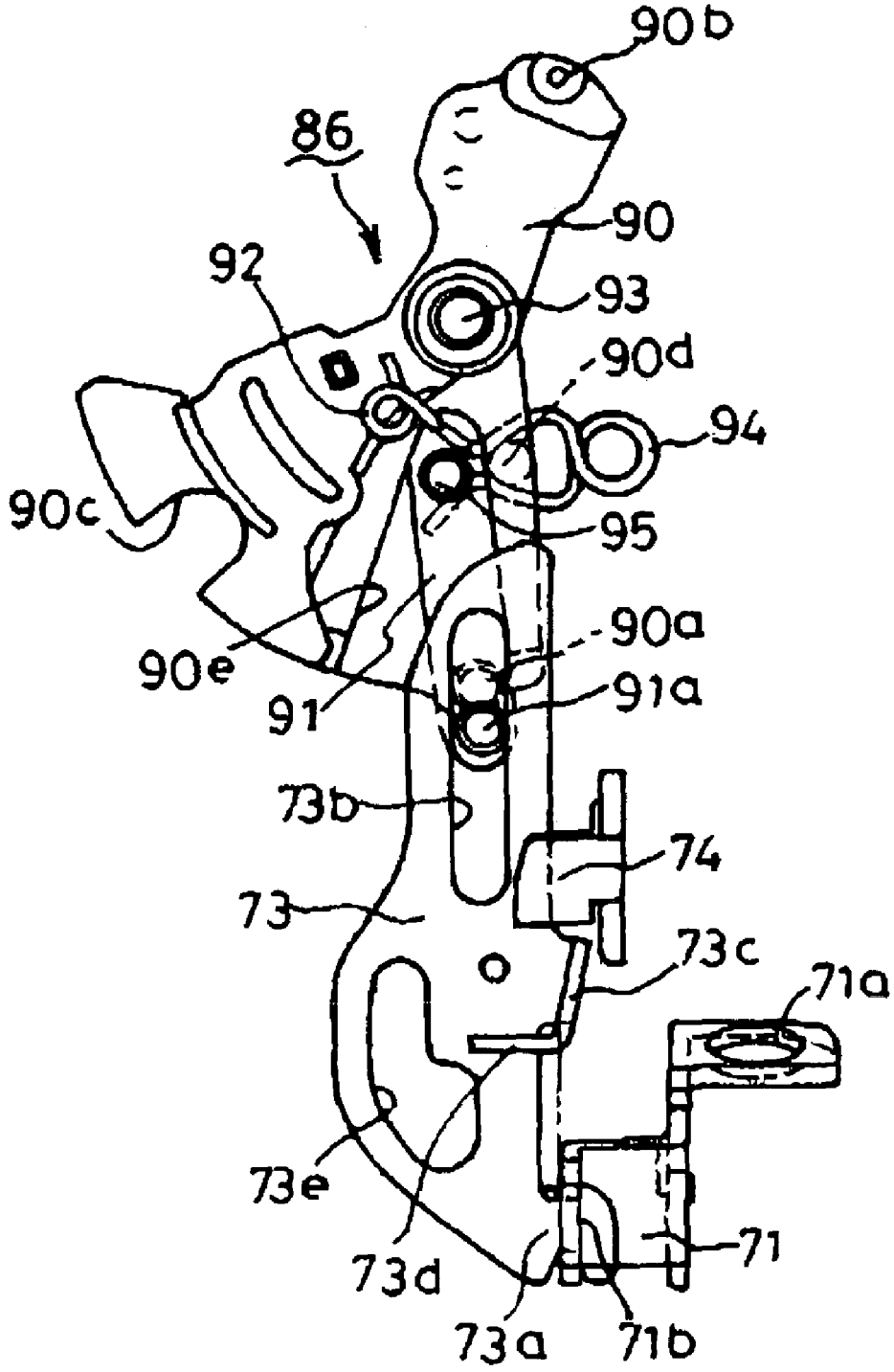
FIG. 10 is a plane view showing the unlocked state of the lock mechanism of the door lock device according to the second embodiment of the present invention.
Figure 11:
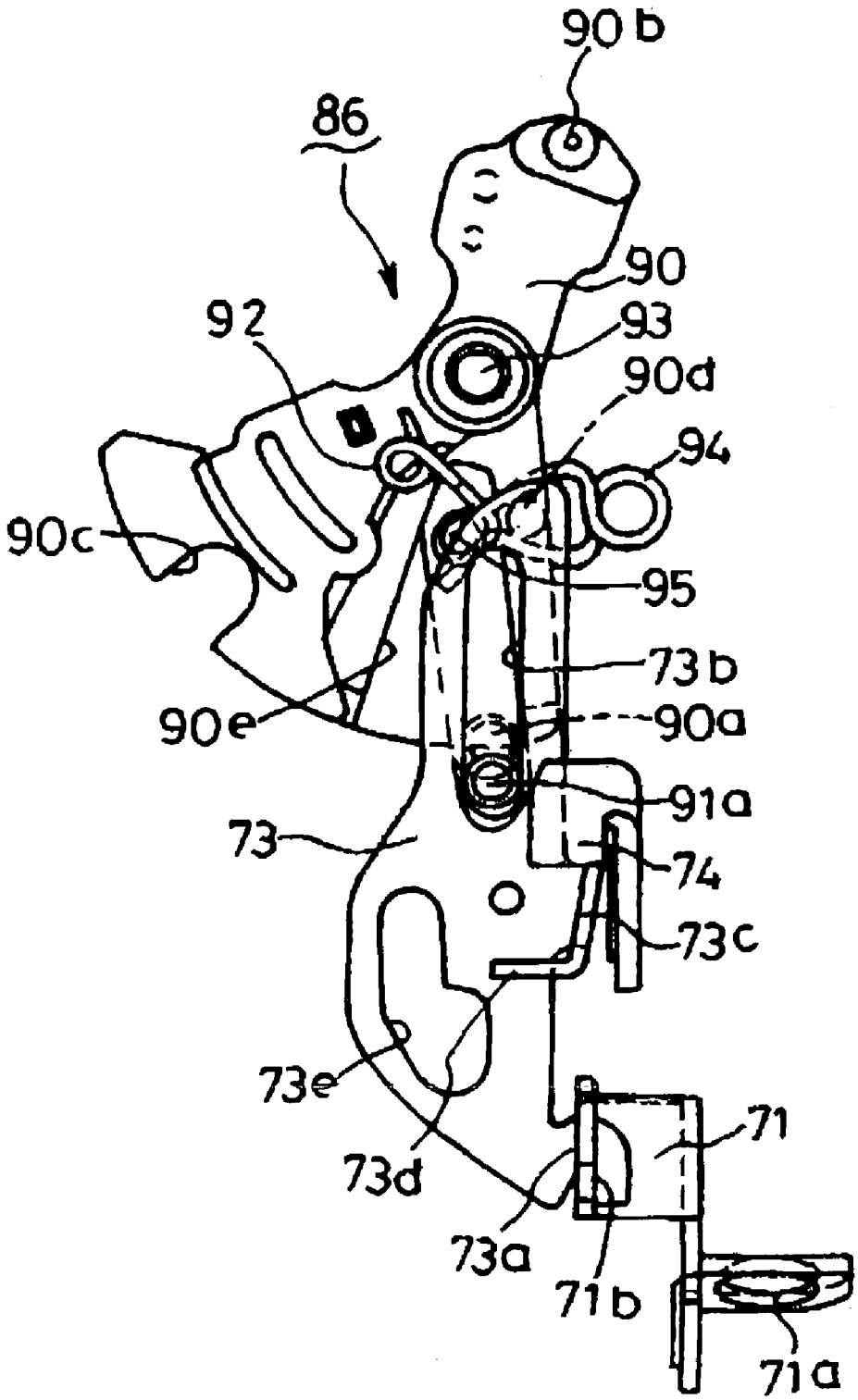
FIG. 11 is a plane view showing a state in which the door handle is operated in the unlocked state of the lock mechanism of the door lock device according to the second embodiment of the present invention.

An operation of the door lock device 50 is explained referring to FIGS. 10–15. FIG. 10 shows the unlocked state of the door lock device 50. In the unlocked state, the flange 73*c* of the open link 73 is provided below the lift lever 74. That is, the flange 73*c* is in the unlocked position. The active lever 86 as a whole is also in the unlocked position. When the door is operated to open due to the operation of the outside door handle and the like in this state, the open link 73 is moved upward via the outside open lever. The flange 73*c* of the open link 73 becomes engaged with the lift lever 74 in the vehicle upward direction (one direction). The lift lever 74 can be movable upward and thus the pawl 12 and the latch 11 are operated (i.e. in the unlatched state) as shown in FIG. 11. When the open link 73 is moved, the connecting pin 91*a* of the sub lever 91 is relatively moved within the elongated hole 73*b* of the open link 73.

Figure 12:
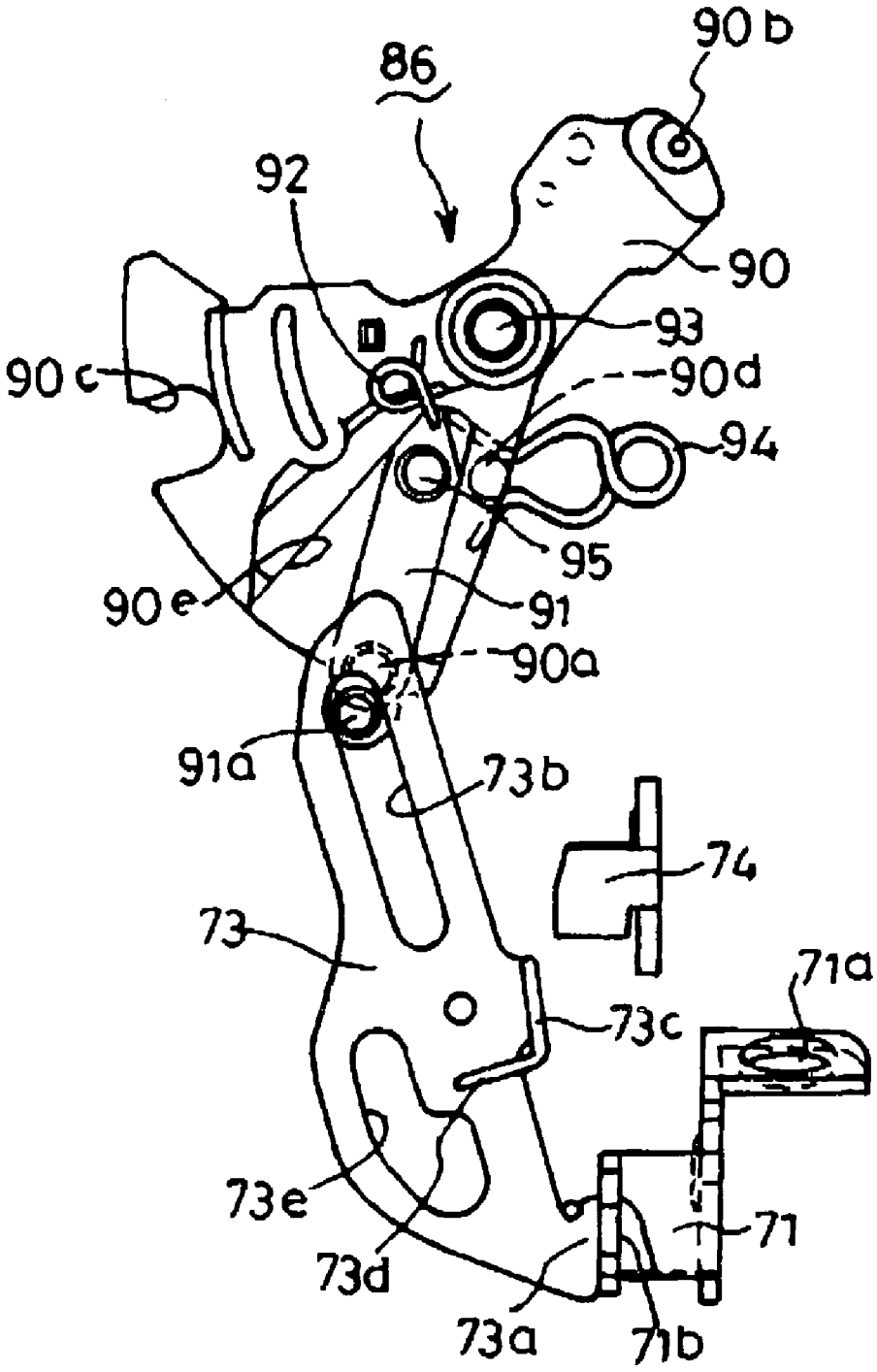
FIG. 12 is a plane view showing the locked state of the lock mechanism of the door lock device according to the second embodiment of the present invention.

In case that the locked operation (switching to the locked state) is performed in the unlocked state shown in FIG. 10 due to the activation of the motor 84 for example, a rotation force from the motor 84 is applied to the main lever 90 via the wheel gear 85, thereby rotating the main lever 90 in the clockwise direction in FIG. 10 with respect to the shaft 93. The sub lever 91 is pushed by the right side wall of the concave portion 90*e* and thus the active lever 86 as a whole is moved in the clockwise direction in FIG. 10 with a predetermined amount with respect to the shaft 93. The rotation force of the active lever 86 is applied to the open link 73 via the connecting pin 91*a* and the elongated hole 73*b*. Then, the open link 73 rotates in the counterclockwise direction in FIG. 10 with a predetermined amount with respect to the connecting portion 73*a* as shown in FIG. 12. In FIG. 12, the active lever 86 as a whole and the open link 73 are in the locked state as in the locked position.

When a rotation force due to the activation of the motor 84 and the like is applied to the main lever 90 in the counterclockwise direction in FIG. 12 from the locked state as shown in FIG. 12, the sub lever 91 rotates with the main lever 90 as a unit due to a biasing force of the spring 92. The active lever 86 as a whole rotates in the counterclockwise direction in FIG. 12 with a predetermined amount with respect to the shaft 93. The open link 73 is then moved to the unlocked position and placed in the unlocked state as shown in FIG. 10. According to the present embodiment, the biasing force of the spring 92 is set larger than a torque required for the open link 73 to be moved from the locked position to the unlocked position, and a torque (based on a biasing torque of the control spring 94) required for the main lever 90 to be moved from the locked position to the unlocked position. Thus, the sub lever 91 does not relatively rotate to the main lever 90 in the above-mentioned state.

Figure 13:
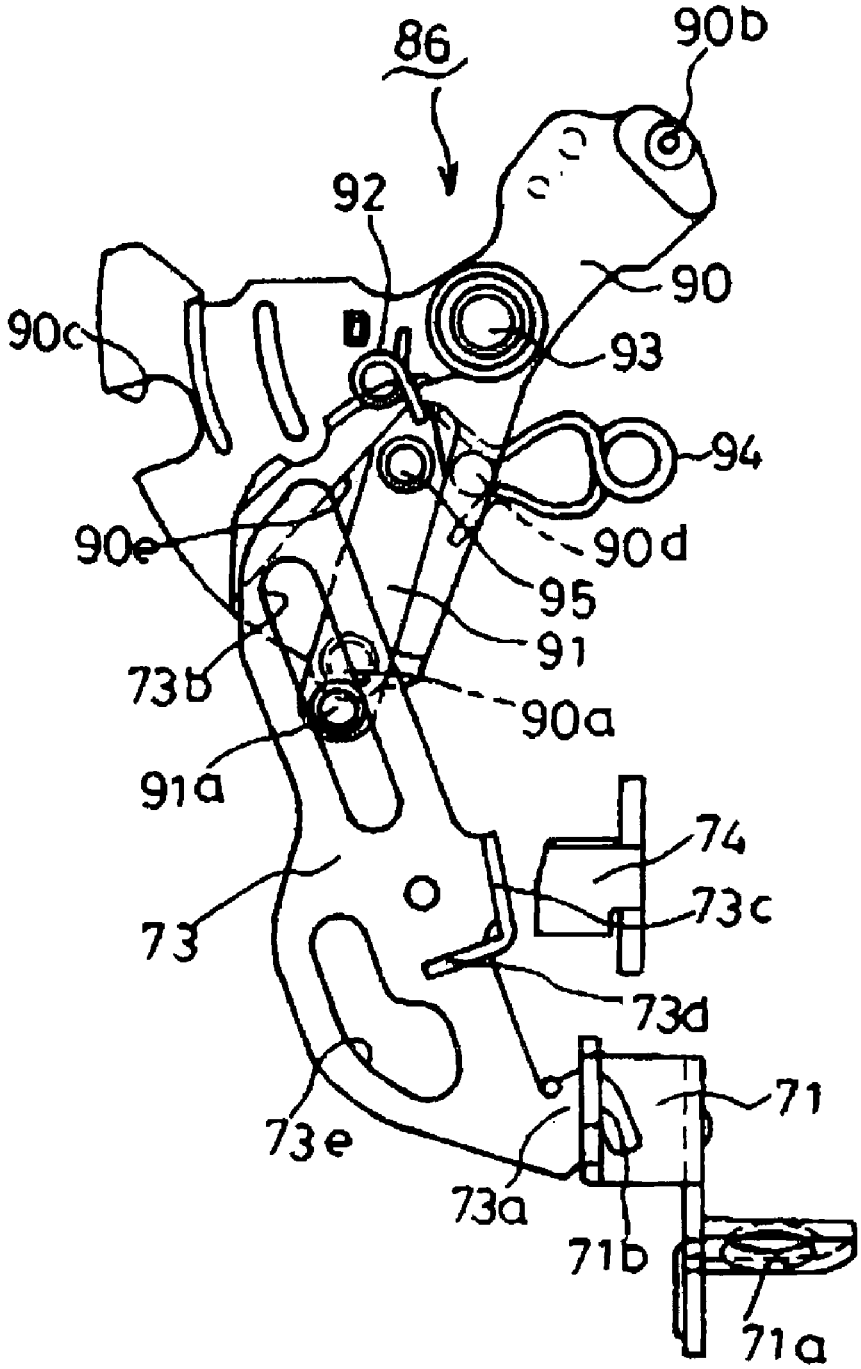
FIG. 13 is a plane view showing a state in which the door handle is operated in the locked state of the lock mechanism of the door lock device according to the second embodiment of the present invention.
Figure 14:
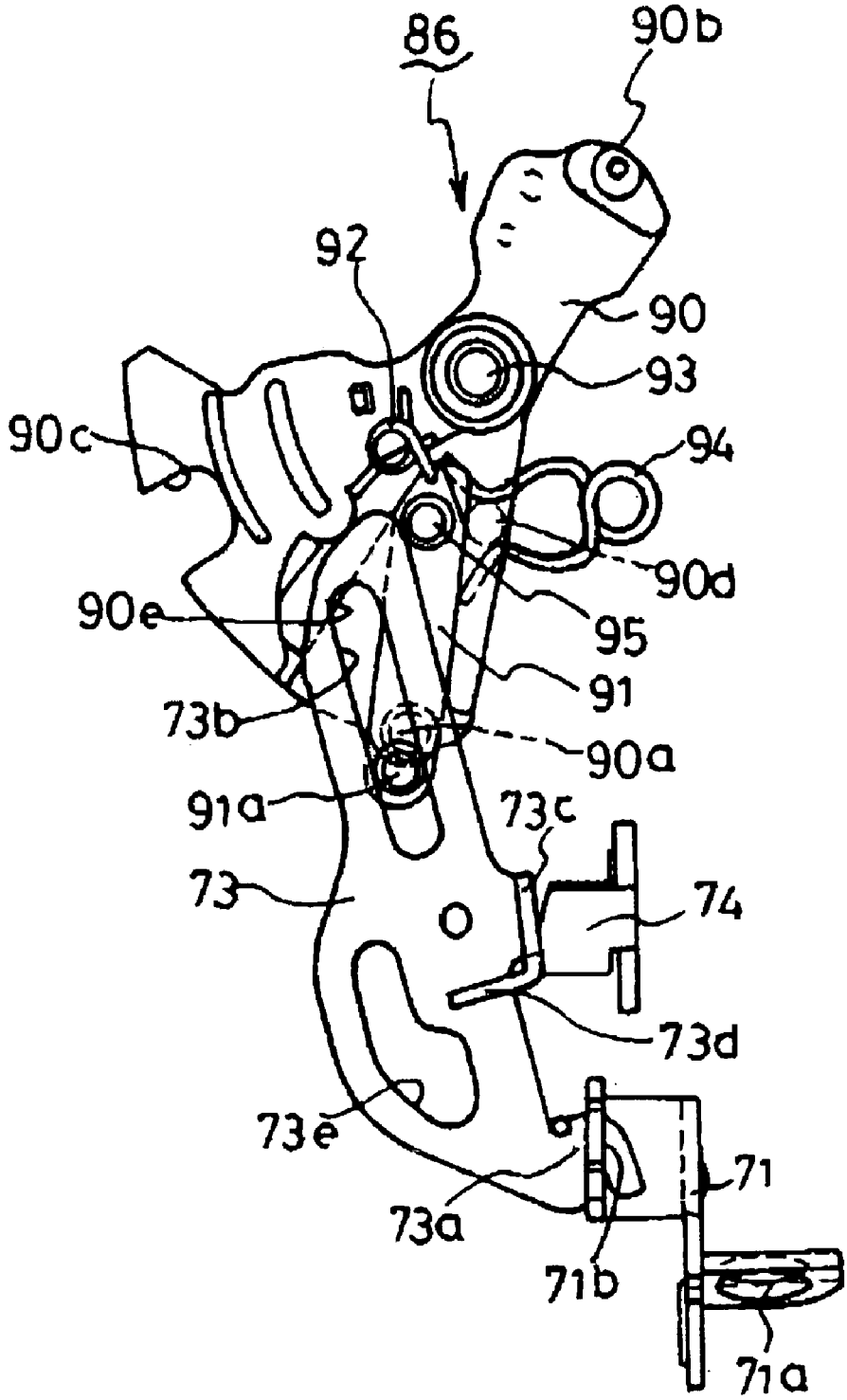
FIG. 14 is a plane view showing a state in which the unlock operation is performed from the state of FIG. 13.

When the outside handle is operated in the locked state (door is operated to open), the open link 73 is moved in substantially upward direction as shown in FIG. 13. At this time, the flange 73*c* idly engages with the lift lever 74, which results in a disengagement between the open link 73 and the lift lever 74. Thus, when the vehicle door is operated to open in the locked state, the vehicle door is not in the unlatched state since the lift lever 74 cannot be operated.

Figure 15:
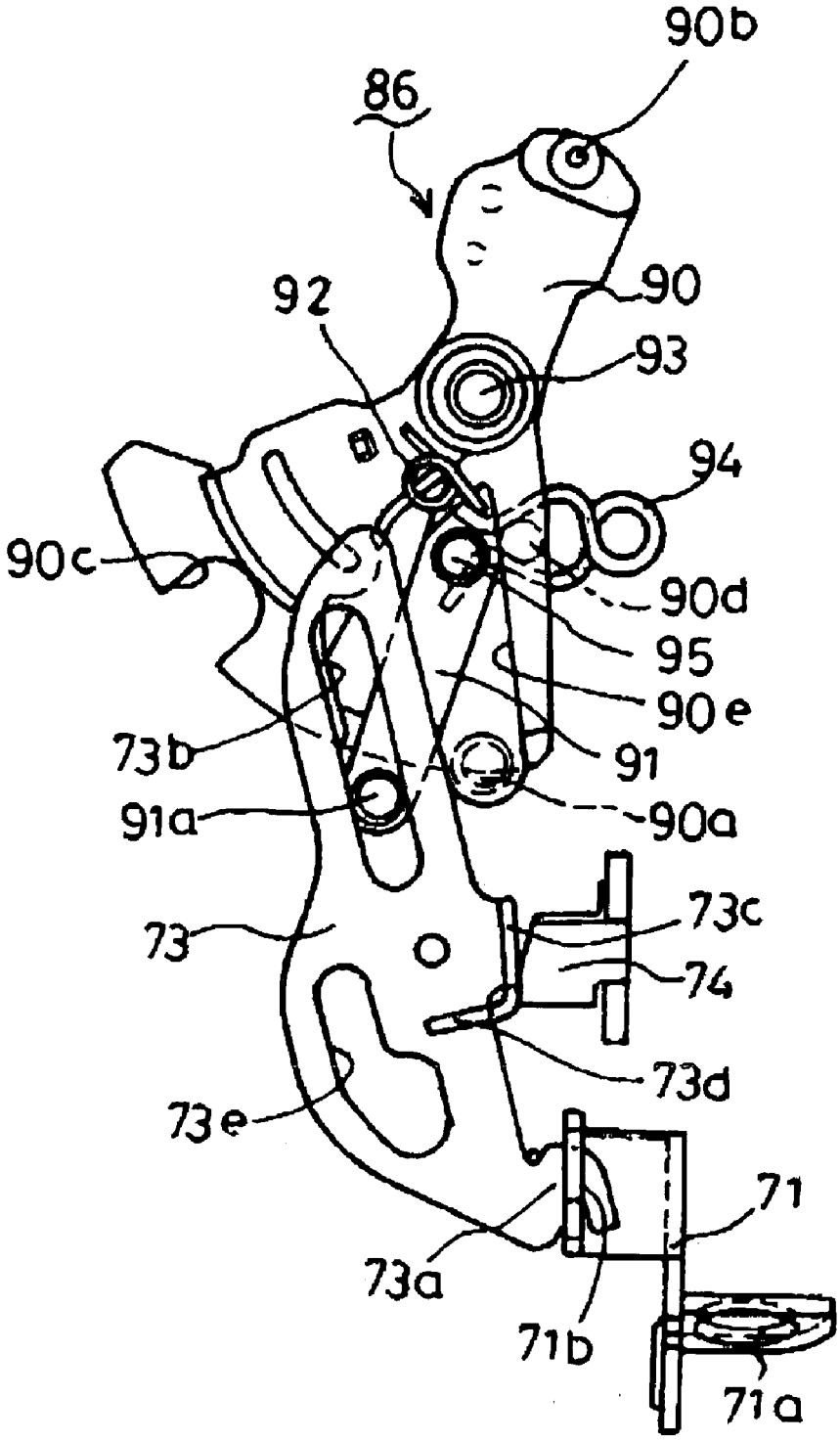
FIG. 15 is a plane view showing a state in which the unlock operation is further performed from the state of FIG. 14.

In case that the unlocked operation (switching to the unlocked state) is performed in the state shown in FIG. 13 via the activation of the motor 84 for example, the active lever 86 as a whole rotates in the counterclockwise direction in FIG. 13 with respect to the shaft 93 with a predetermined amount. At this time, the open link 73 rotates in the clockwise direction in FIG. 13 with respect to the connecting portion 73*a* with a predetermined amount. The flange 73*c* then engages with the lift lever 74 in the vehicle rearward direction, i.e. rightward direction in FIG. 14 (other direction), thereby allowing the lift lever 74 operable in this case, however, the sub lever 91 relatively rotates to the main lever 90 with respect to the shaft 95 as shown in FIG. 15. That is, the sub lever 91 is moved within the concave portion 90*e* and then brought into contact with the left side wall of the concave portion 90*e* in FIG. 15. The sub lever 91 rotates against the biasing force of the spring 92.

The main lever 90 of the active lever 86 can be moved to the unlocked position without restricted by the open link 73 and the sub lever 91 connected to the open link 73 due to the sub lever 91 relatively rotate to the main lever 90.

In case that the outside handle is returned to the normal position (i.e. open operation is cancelled) from a state shown in FIG. 15, the open link 73 is moved downward in FIG. 15 whereby the engagement between the flange 73*c* and the lift lever 74 is released. Then, the sub lever 91 returns to the initial position where the sub lever 91 is in contact with the right side wall in FIG. 15 of the concave portion 90*e* from a position where the sub lever 91 is in contact with the left side wall in FIG. 15 of the concave portion 90*e*. That is, the sub lever 91 returns to the unlocked position and placed in the unlocked state as shown in FIG. 10.

As indicated above, even when the outside handle and the motor are operated at substantially the same time in the locked state, the door is switched to the unlocked state when the outside handle is returned to the normal position. It is not required to unlock the door again and thus the bother of operating the outside handle again can be prevented.

According to the above-mentioned embodiment, the open link 73 is not to be divided for the purpose of preventing the bother of operation. Thus, it is stable when the open link 73 engages with the lift lever 74 and operated therewith under the normal door opening operation.

An operation performed when the inside handle is operated from the locked state in FIG. 12 is explained in the following according to the second embodiment of the present invention. In case that the inside handle is operated, the inside open lever 72 is operated with the cancel lever 75 as described above. Then, the open link 73 rotates in the clockwise direction in FIG. 12 with respect to the connecting portion 73*a* by being applied the rotation force from the cancel lever 75 via the boss 75*b* formed at the cancel lever 75 and the hole 73*e*. That is, the rotation force is applied to the open link 73 to be moved to the unlocked position. Further, the active lever 86 as a whole rotates in the counterclockwise direction in FIG. 12 with respect to the shaft 93 by being applied the rotation force from the open link 73 via the elongated hole 73*b* and the connecting pin 91*a*. That is, the rotation force is applied to the active lever 86 to be moved to the unlocked position.

At the same time, the operation force is input to the flange 73*d* of the open link 73 from the projecting portion 72*b* of the inside open lever 72. The open link 73 is then moved upward. The flange 73*c* of the open link 73 is engageable with the lift lever 74 in the upward direction as shown in FIG. 11 and thus the lift lever 74 is moved. The pawl 12 and the latch 11 are moved (i.e. in unlatched state) accordingly. The door lock device 50 is constituted so that the door can be opened without performing the unlocked operation when the inside handle is operated once in the locked state (i.e. one motion operation is possible).

Figure 16:
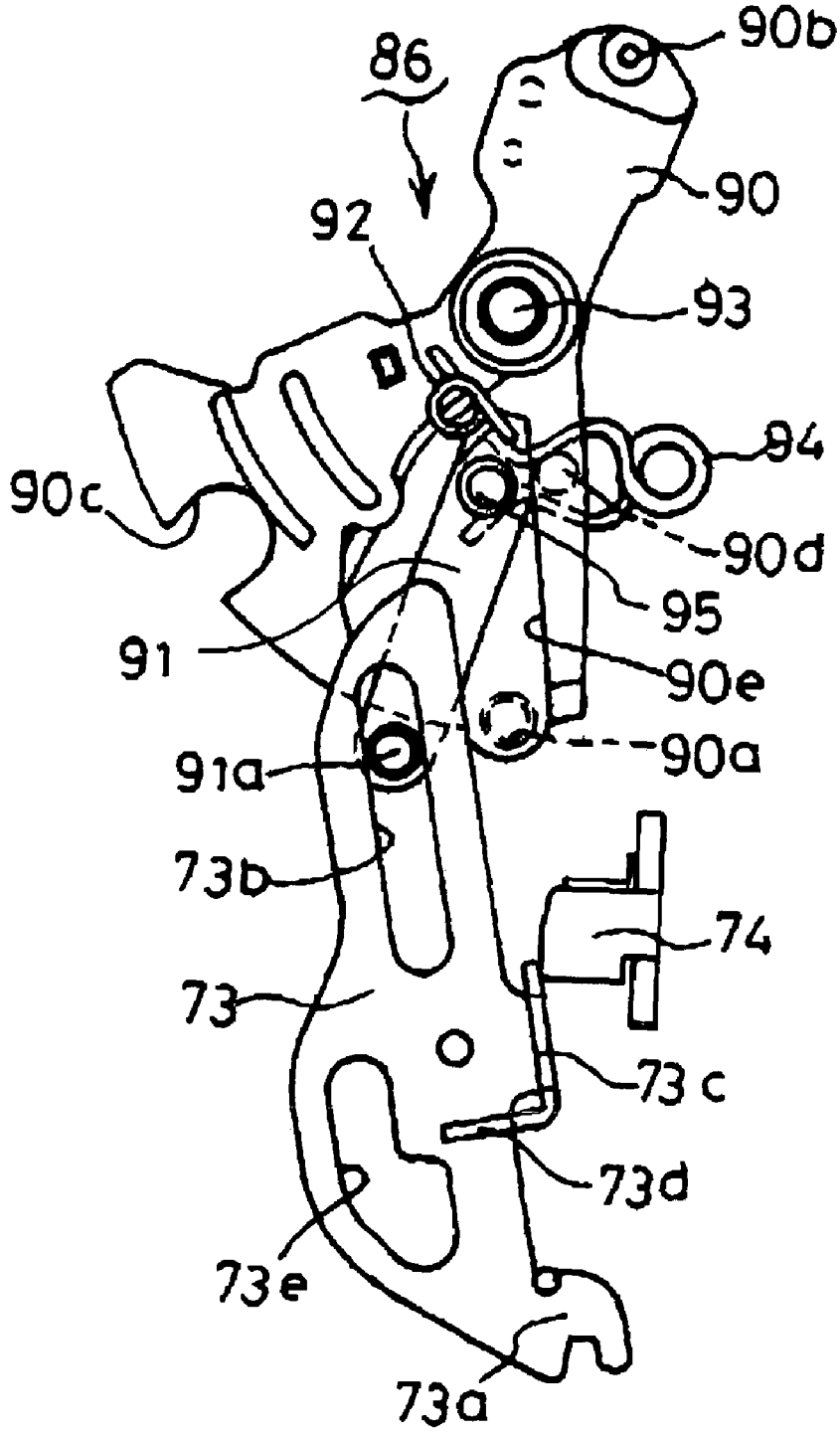
FIG. 16 is a plane view showing a state in which an inside handle is operated in the locked state of the door lock device according to a third embodiment of the present invention.
Figure 17:
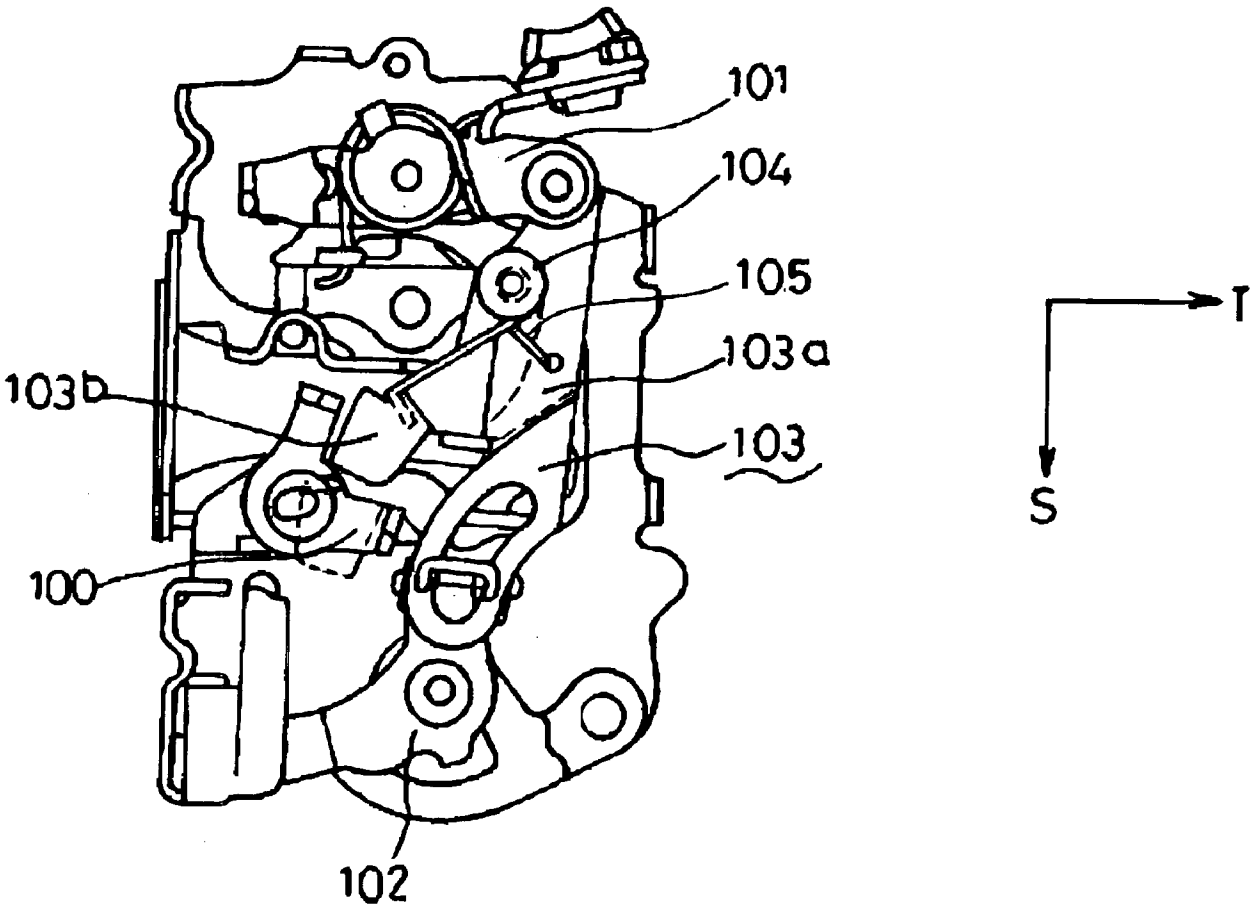
Fig. 17 Prior Art
FIG. 17 is a plane view of a conventional door lock device.

A third embodiment of the present invention is explained referring to FIG. 16. In the third embodiment, a length of the flange 73*c* in a vertical direction in FIG. 16 is set longer than that of the second embodiment. The rest structure of the third embodiment is same as that of the second embodiment.

According to the third embodiment, when the inside handle is operated one time from the locked state, the open link 73 rotates by the operation of the inside open lever 72 and the cancel lever 75. In the same way as the second embodiment and then become a state shown in FIG. 16. The flange 73*c* engages with the lift lever 74 in the vehicle rearward direction i.e. rightward direction in FIG. 16 (other direction). In this case, the lift lever 74 is not moved and thus the pawl 12 and the latch 11 cannot be operated by one operation of the inside handle. However, the main lever 90 of the active lever 86 can be moved to the unlocked position due to the sub lever 91 relatively rotating to the main lever 90 with respect to the shaft 95. When the inside handle is returned to the normal position, the engagement between the flange 73*c* and the lift lever 74 is released and then the unlocked state is obtained as shown in FIG. 10. When the inside handle is operated again, the door can be opened.

As mentioned above, when the inside handle is operated twice in the locked state, the door can be opened without performing the unlocked operation (two-motion operation is possible) according to the third embodiment of the door lock device 50. According to the second and the third embodiments, the door lock device 50 can easily achieve both one-motion operation mechanism and two-motion operation mechanism only by changing the length of the flange 73*c*.

According to the embodiments of the present invention, even when the door open member and the locking/unlocking member are operated at substantially the same time, a panic state is not caused and the vehicle door is switched to the unlocked state. It is not required to operate the locking/unlocking member again, which prevents the bother of operation. In addition, the open member for engaging with the lift lever is not divided according to the above embodiments. Thus, the open member is stable when engaging with the lift lever in the unlocked state.

The vehicle door can be opened relative to the vehicle body by operating the inside handle once or twice in the locked state, which depends on the structure of the engaging portion of the open member. Briefly, number of operations of the inside handle for opening the door from the locked state can be determined by changing the structure of the engaging portion of the open member.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A door lock device comprising:

a latch mechanism provided at a vehicle door and engageable with or disengageable from a striker provided at a vehicle-body;

a lift lever for operating the latch mechanism from an engaged state to a disengaged state;

an open lever operated by an operation of a door opening mechanism provided at the vehicle door;

an open member rotatably supported on the open lever and movable by the open lever upon operation of the door opening mechanism;

a lock lever movable between an unlocked position and a locked position by an operation of a door locking/unlocking member provided at the vehicle door and including a main lever connected to the door locking/unlocking member and a sub lever connected to the open member and mounted on the main lever so as to relatively rotate thereto;

a biasing member disposed between the main lever and the sub lever for biasing the sub lever to an initial position before the rotation of the sub lever relative to the main lever starts; and the open member and the lock lever comprising parts that engage one another so that the open member is operated by the lock lever to move from an unlocked position in which the open member is brought into contact with the lift lever to operate the latch mechanism when the open member is moved by the open lever upon operation of the door opening mechanism to a locked position in which the open member is unable to contact the lift lever when the open member is moved by the open lever upon operation of the door opening mechanism.

2. A door lock device according to claim 1, wherein the door opening mechanism includes an inside handle provided at an inboard side of the vehicle door, and when the inside handle is operated under the open member being in the locked position, a cancel lever is operated together with the open lever to shift the open member to the unlocked position and at the same time, a contacting portion formed at the open member for engaging with the lift lever becomes engaged with the lift lever.

3. A door lock device according to claim 1 wherein the door opening mechanism includes an inside handle provided at an inboard side of the vehicle door, and when the inside handle is operated under the open member being in the locked position, a cancel lever is operated together with the open lever to shift the open member to the unlocked position and at the same time, a contacting portion formed at the open member for engaging with the lift lever becomes engaged with the lift lever.

4. A door lock device according to claim 1, wherein the main lever includes a concave portion within which the sub lever is movable and constantly biased to be in contact with one side wall of the concave portion by the biasing member.

5. A door lock device according to claim 4, wherein the door opening member includes an outside handle provided at an outboard side of the vehicle door, and when the outside handle is operated under the open member being in the locked position, the sub lever is moved within the concave portion and becomes in contact with the other side wall of the concave portion against a biasing force of the biasing member.

6. A door lock device according to claim 5, wherein the sub lever is returned to a position where the sub lever is in contact with the one side wall of the concave portion when the outside handle is returned to a normal position.

7. A door lock device according to claim 2, wherein the open member receives a rotation force from the cancel lever via a boss formed at the cancel lever and a hole formed at the open member.

8. A door lock device according to claim 7, wherein the lock lever receives a rotation force from the open member via an elongated hole formed at the open member and a connecting pin formed at the sub lever.

9. A door lock device comprising:

a latch mechanism provided at a vehicle door and engageable with or disengageable from a striker provided at a vehicle-body;

a lift lever for operating the latch mechanism from an engaged state to a disengaged state;

an open lever operated by operation of a door opening mechanism provided at the vehicle door;

a lock lever movable between an unlocked position and a locked position by operation of a door locking/unlocking member provided at the vehicle door and including a main lever connected to the door locking/unlocking member and a sub lever connected to the open member and mounted on the main lever so as to be rotatable relative to the main lever;

a biasing member disposed between the main lever and the sub lever for biasing the sub lever to an initial position before the rotation of the sub lever relative to the main lever starts;

an open member operated by the lock lever to move the open member from an unlocked position to a locked position, the open member rotatably supported on the open lever so that the open member in the unlocked position moves together with the open lever when the open lever is operated by operation of the door opening mechanism and so that the open member in the locked position moves together with the open lever when the open lever is operated by operation of the door opening mechanism, the open member in the unlocked position contacting the lift lever to operate the latch mechanism when the open lever is moved, and the open member in the locked position being unable to contact the lift lever when the open lever is moved so that the latch mechanism is not operated.

10. A door lock device according to claim 9, wherein the door opening mechanism includes an inside handle provided at an inboard side of the vehicle door, and when the inside handle is operated with the open member in the locked position, a cancel lever is operated together with the open lever to shift the open member to the unlocked position and at the same time, a contacting portion formed at the open member for engaging with the lift lever becomes engaged with the lift lever.

11. A door lock device according to claim 9, wherein the main lever includes a concave portion within which the sub lever is movable and constantly biased to be in contact with one side wall of the concave portion by the biasing member.

12. A door lock device according to claim 11, wherein the door opening member includes an outside handle provided at an outboard side of the vehicle door, and when the outside handle is operated under the open member being in the locked position, the sub lever is moved within the concave portion and becomes in contact with the other side wall of the concave portion against a biasing force of the biasing member.

13. A door lock device according to claim 12, wherein the sub lever is returned to a position where the sub lever is in contact with the one side wall of the concave portion when the outside handle is returned to a normal position.

14. A door lock device according to claim 10, wherein the open member receives a rotation force from the cancel lever via a boss formed at the cancel lever and a hole formed at the open member.

15. A door lock device according to claim 14, wherein the lock lever receives a rotation force from the open member via an elongated hole formed at the open member and a connecting pin formed at the sub lever.

* * * * *